US006010042A

United States Patent [19]

Boucher et al.

[11] Patent Number: 6,010,042

[45] Date of Patent: Jan. 4, 2000

[54] BASE END DISPENSING CONTAINER WITH TOP END VALVE OPERATOR

[76] Inventors: Mark Boucher, 752 Maple St., Manchester, N.H. 03104; Gregory D. H. Jones, 30 Armands Way, Dunbarton, N.H. 03045

[21] Appl. No.: 09/179,582

[22] Filed: Oct. 27, 1998

[51] Int. Cl.[7] ..... B67D 3/00

[52] U.S. Cl. ..... 222/510; 222/548; 222/185.1; 222/212

[58] Field of Search ..... 222/548, 510, 222/185.1, 212

[56] References Cited

U.S. PATENT DOCUMENTS

| | | | |
|---|---|---|---|
| 1,190,325 | 7/1916 | Rosenthal | 222/548 |
| 1,523,122 | 1/1925 | Hellmann | 222/548 |
| 1,939,582 | 12/1933 | Thompson | 222/510 |
| 2,123,606 | 7/1938 | Latocha | 221/112 |
| 2,197,672 | 4/1940 | Winters | 221/60 |
| 2,487,825 | 11/1949 | Olvis | 222/548 |
| 2,556,782 | 6/1951 | Venters | 222/181 |
| 2,630,246 | 3/1953 | Gilmore | 222/510 |
| 2,704,623 | 3/1955 | Yasso | 222/548 |
| 3,136,457 | 6/1964 | Via, Sr. | 222/510 |
| 3,556,469 | 1/1971 | Barger | 251/144 |
| 4,020,982 | 5/1977 | Micallef | 222/554 |
| 4,345,859 | 8/1982 | Robertson | 406/128 |
| 4,462,510 | 7/1984 | Steer et al. | 222/48 |
| 4,516,697 | 5/1985 | Dreps et al. | 222/548 |
| 4,653,672 | 3/1987 | Tuerk et al. | 222/153 |
| 4,762,458 | 8/1988 | van der Merwe et al. | 414/378 |
| 5,165,581 | 11/1992 | Uhl | 222/480 |
| 5,655,687 | 8/1997 | Fitten et al. | 222/212 |
| 5,669,527 | 9/1997 | Hardy | 221/191 |
| 5,678,737 | 10/1997 | White | 222/484 |
| 5,738,136 | 4/1998 | Rosenberg | 137/12 |

*Primary Examiner*—Joseph A. Kaufman
*Assistant Examiner*—David Deal
*Attorney, Agent, or Firm*—Bourque & Associates, P.A.

[57] ABSTRACT

A base end dispensing container, especially suitable for dispensing viscous flowable liquid consumable products is disclosed. The container includes an elongated, squeezable container having an inner chamber for holding the viscous flowable liquid consumable products, a base end dispensing valve, a top end valve operating mechanism and an attached support structure for supporting the container in an upright position a distance from a surface upon which the container is placed. The base end dispensing valve includes a sloping container floor terminating at a substantially flat section, upon which a rotationally operable valve gate rests. The substantially flat floor section of the container includes at least one dispensing opening intermediate the interior chamber of the container and the outside of the container. The valve gate is selectively operated between an open and shut position by the top end valve operating mechanism via a valve drive shaft which connects the valve operating mechanism with the rotationally operable valve gate.

11 Claims, 5 Drawing Sheets

BASE END DISPENSING CONTAINER WITH TOP END VALVE OPERATOR

FIELD OF THE INVENTION

This invention relates to containers and, in particular, to a base end dispensing container for selectively dispensing viscous liquid materials, such as mustard, ketchup and the like.

BACKGROUND OF THE INVENTION

Dispensing containers are know for holding viscous liquid condiments, such as ketchup, mustard, honey and other viscous liquids. Such containers typically have a base for supporting the container and some type of opening or valve at the opposite end of the base for dispensing the liquid material from an inner cavity of the container. Either the valve is closed or a cap is installed on the container during period when the container is not being used.

In most containers, the viscous liquid materials contained therein tend to gravitate toward the base, which is at the opposite end of the opening of the container. With such containers, when the container is completely filled, material in the container may be easily dispensed through the opening at the top end of the container. However, when the container approaches being empty, it is difficult to dispense viscous liquid materials which are seated at the base of the contained opposite the container's opening. Thus, the user must vigorously shake or hit the container to empty all of its contents. And, in practice, since it is difficult to remove all of the container's contents, some of the contents remain in the container when it is either disposed of or recycled.

A number of inventions have sought to solve the problem of removing substantially all of the viscous liquid contents from a container. In particular, U.S. Pat. No. 5,655,687, which issued to Fitten et al. on Aug. 12, 1997, discloses a base end dispensing container with a travel cap. The Fitten invention is specifically directed to a container that is useful for flowable materials, such as bath products, shampoos, conditioners and liquid soaps. However, since this patent does not concern human consumable liquids, it does not consider the problems associated with contamination of the container's contents through the base end dispensing valve. In addition, the Fitten invention utilizes a removable cap, which must be affixed on top of the base end dispensing valve to positively seal the container to avoid the inadvertent dispensing of its contents.

U.S. Pat. No. 2,123,606, which issued to Latocha on Jul. 12, 1938, also discloses a base end dispensing device. This device includes an operating valve, which is located at the top of container, opposite a base end dispensing valve. However, this valve uses a rather complex spring-operated mechanism and vertical movement in order to dispense an amount of the container's contents. Thus, the Latocha invention is rather expensive to produce. In addition, the Latocha container is made of a non-deformable material such as glass or the like. Furthermore, the Latocha device is especially configured to hold and dispense granular solid materials, such as sugar and is not especially suitable for the dispensing of viscous liquids.

Accordingly, what is needed is a base end dispensing container, suitable for dispensing viscous liquid consumable products, such as ketchup, mustard, honey and the like, that elevates the dispensing valve from the area of the base end upon which the container rests to prevent contamination of the contents of the container and which includes a rotationally operable valve, which is operated from the top end of the container, remote from the base end dispensing valve, and which positively seals the dispensing valve without dispensing any more of the container's contents than is precisely desired.

SUMMARY OF THE INVENTION

The present invention satisfies these needs by providing a base end dispensing container, especially suitable for dispensing viscous flowable liquid consumable products that includes an elongated, squeezable container having an inner chamber for holding the viscous flowable liquid consumable products, a base end dispensing valve, a top end valve operating mechanism and an attached support structure for supporting the container in an upright position a distance from a surface upon which the container is placed. The base end dispensing valve includes a sloping container floor terminating at a substantially flat floor section, upon which a rotationally operable valve gate rests. The valve gate is selectively operated between an open and shut position by the top end valve operating mechanism via a valve drive shaft which connects the valve operating mechanism with the rotationally operable valve gate. The substantially flat floor section of the container includes at least one dispensing opening communicating between the interior chamber of the container and the outside of the container. The dispensing opening is selectively opened and shut when the valve gate is rotated between its open and shut position.

In a preferred embodiment, the valve gate is shaped in a manner such that it has a top end distal from the container floor which is smaller in area than a bottom end, which is proximal the container floor. In this manner, the viscous flowable liquid contained within the container is easily directed to the base end dispensing opening under the force of gravity at all times while base end dispensing container is in an upright position.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
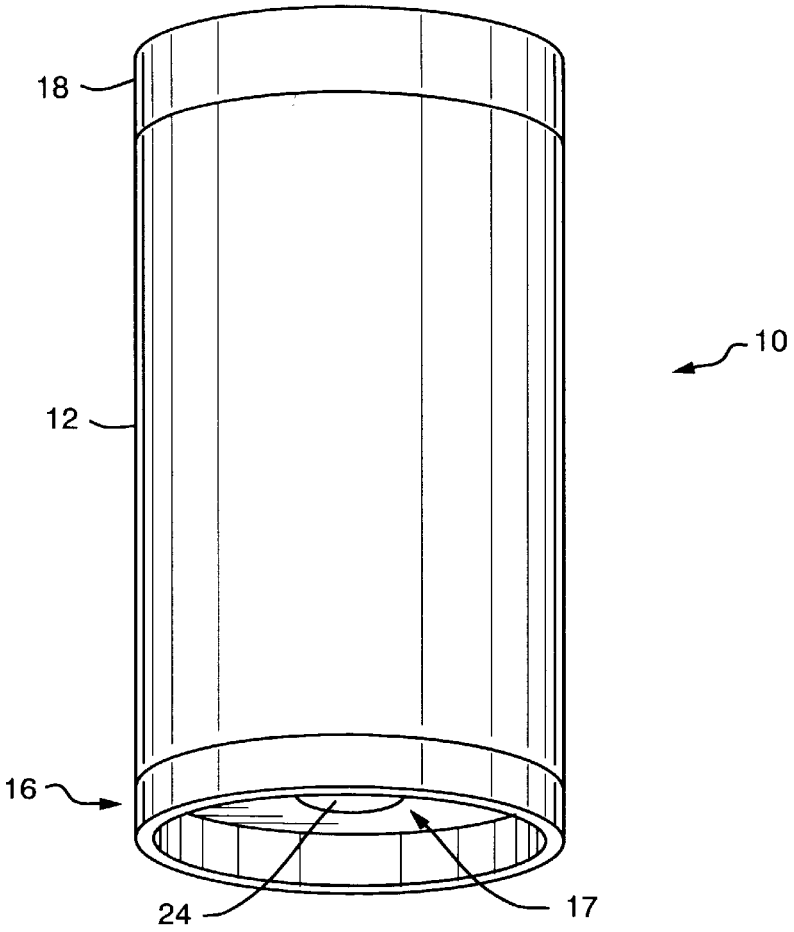
FIG. 1 is a perspective view of the base end dispensing container of the present invention.
Figure 2:
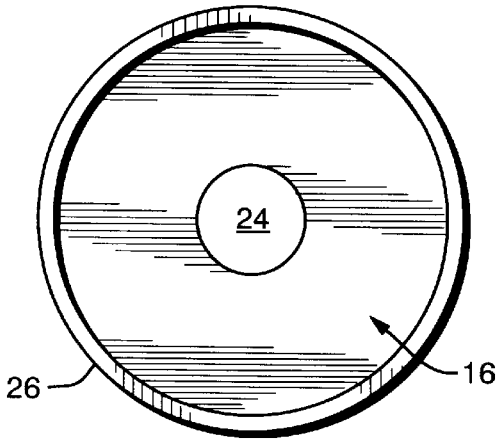
FIG. 2 is a bottom view of the base end dispensing container shown in FIG. 1.

Turning now to the figures, and in particular FIGS. 1 through 4B, a base end dispensing container 10 is shown. The container includes an elongated, squeezable container 12 having an inner chamber 14, which is especially suitable for holding viscous flowable liquids of the consumable nature, such as ketchup, mustard, honey and the like, although the principles of invention are equally applicable to containers for other, non-consumable liquid materials. The squeezable container 12 has a lower base end 16 and an upper top end 18.

The base end 16 comprises a base end dispensing valve 17, which includes a sloping floor 20. In the embodiment shown, sloping floor 20 terminates in a substantially flat floor area 22 upon which a base end valve gate 30 sits.

The base end 16 of the container also includes at least one dispensing opening 24, which extends from flat floor area 22 to the exterior of the container, thereby exposing the interior chamber 14 of the container to the surrounding environment when the base end dispensing valve gate 30 is in an open position. The base end 16 further includes an attached support structure 26, which, in the embodiment shown, includes circumferential legs extending beneath the base end dispensing valve 17 upon which the base end dispensing container 10 rests. These circumferential legs 26 thereby elevate the base end dispensing valve 17 and dispensing openings 24 a distance away from a surface upon which the container 10 is placed. This eliminates problems associated with the contamination of consumable materials contained within container 10 by migration of contaminants through dispensing openings 24.

Figure 4B:
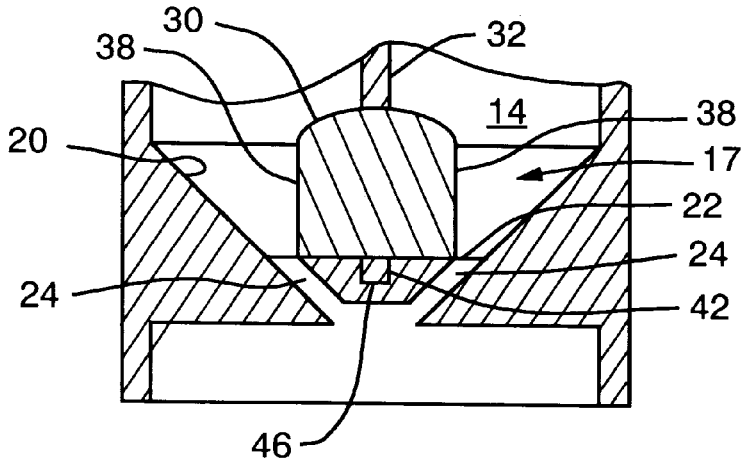
FIG. 4B is a close-up sectional view of the base end of the base end dispensing container shown in FIGS. 1 and 4A.
Figure 4A:
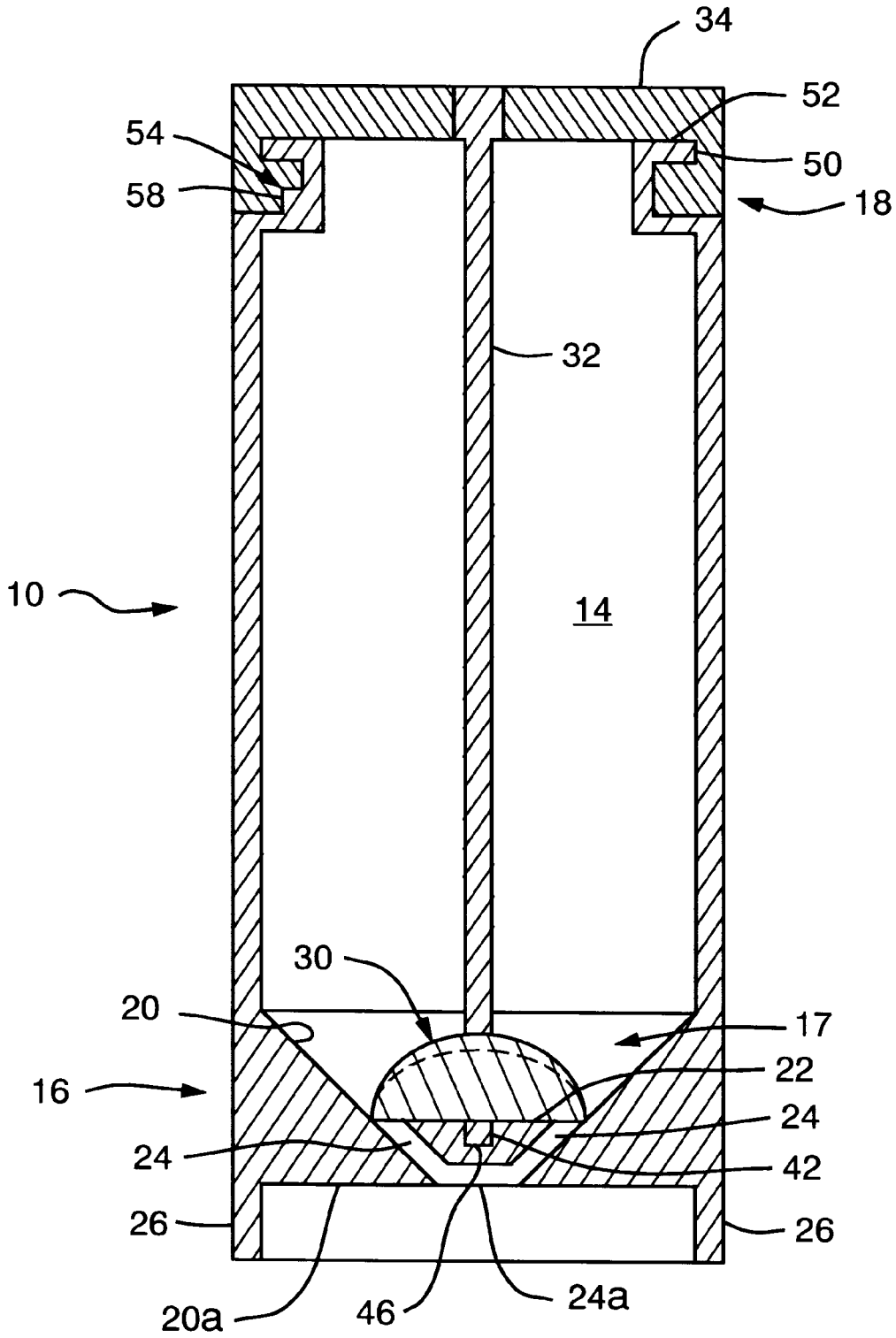
FIG. 4A is a sectional view of the view of the base end dispensing container of FIG. 1.

FIGS. 4A, 4B, 5A and 5B show how the base end dispensing valve operates. In FIG. 4A, the base end dispensing valve 17 is shown in the shut position. As can be seen, in the shut position, valve gate 30 is positioned in a manner such that the valve gate covers dispensing openings 24. This prevents the flowable viscous materials contained within the interior chamber 14 of the container 10 from flowing through the dispensing openings 24 and out of the container. In FIG. 4B, the base end dispensing valve gate 30 is shown in an open position, which in the embodiment shown comprises rotating valve gate 30 substantially 90°. In this manner, missing sections of the valve gate, which have been removed at section edges 38 expose dispensing openings 24 to the interior chamber 14 and allow viscous liquids contained within the interior chamber 14 of container 10 to flow out of the container through dispensing openings 24.

Figure 5A:
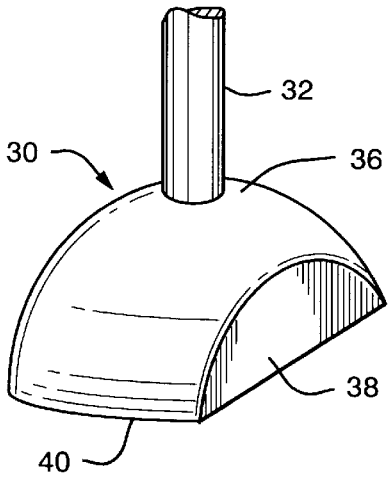
FIGS. 5A and 5B show two embodiments of rotationally operable dispensing valves gates useful in the base end dispensing container of the present invention.
Figure 5B:
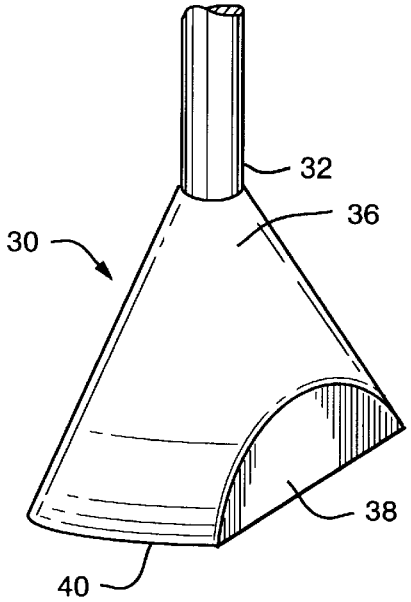

FIG. 5A shows one embodiment of a base end dispensing valve gate 30 according to the present invention. This valve gate comprises a hemispherical valve gate 30 having vertical slices removing sections on opposite sides therefrom to produce substantially vertical section edges 38. Of course, any number of sections can be utilized to correspond with the number of dispensing openings included in the base end dispensing valve 17. Additionally, other non-vertical sections, such as sloping section may work equally well. FIG. 5B shows an alternative embodiment wherein the base end dispensing valve gate 30 comprises a conical valve gate. In a manner similar to the hemispherical valve gate of FIG. 5A, the conical valve gate of FIG. 5B also includes at least section removed therefrom to produce a substantially vertical section 38, which also exposes the interior chamber 14 of the base end dispensing container to base end dispensing openings 24 (FIG. 4B). While these two embodiments of valve gate 30 are shown, alternative valve gate configurations are envisioned by the invention. However, one important consideration, which facilitates the flow of material under the force of gravity toward the base end dispensing openings 24, is that the valve gate 30 has an area, which increases in size from a smaller area top end 36, which is an end distal from the base area flat floor section 22 towards a bottom end 40, which is proximal to the substantially flat base area flat floor section 22.

Of course, other arrangements, such as dual cones having their bases attached and a conically shaped dispensing end floor with alternative dispensing openings, are contemplated as well.

Figure 3:
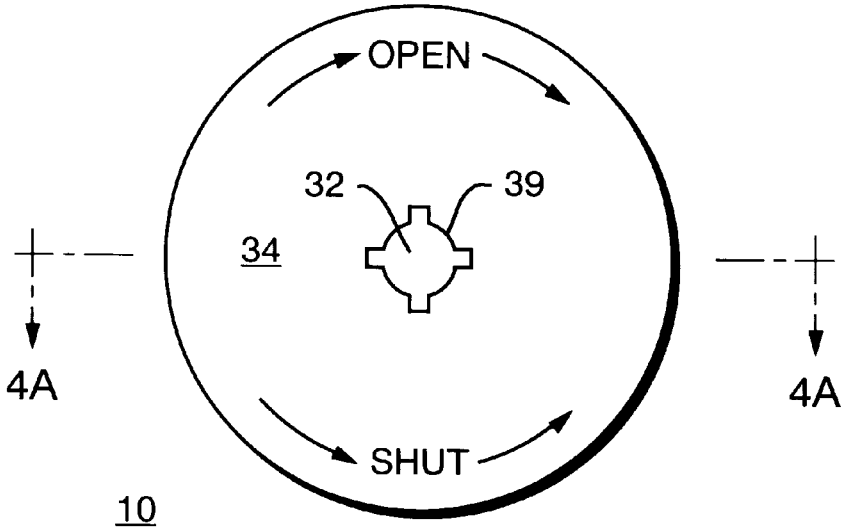
FIG. 3 is a top view of the base end dispensing container shown in FIG. 1.
Figure 6:
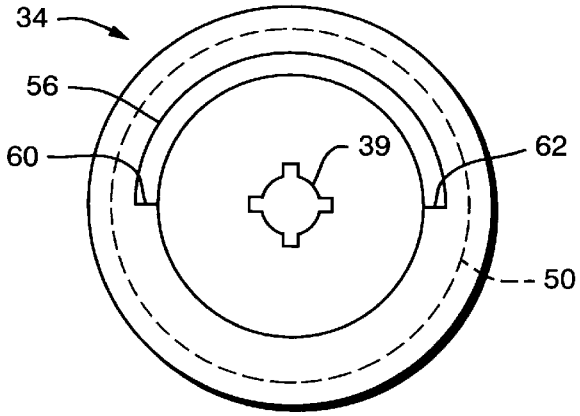
FIG. 6 is a bottom view of the base end container valve operating mechanism of the present invention.

Extending from the base end dispensing valve gate 30 at its top end 36 is valve operating drive shaft 32, which communicates between the valve gate 30 and a valve operator 34, located at the top end 18 of dispensing container 10. The valve operating drive shaft 32 may be integral with the valve operator 34 or it may be a separate drive shaft, which is installed between the valve operator 34 and the valve gate 30. In this case, the valve operating drive shaft must be rotationally fixed where it communicates with both the valve operator 34 and the valve gate 30. This can be accomplished using chemical bonding techniques, thermal bonding techniques or, mechanical techniques such as the cross-shaped valve drive shaft receptacle 39 in valve operator 34 communicating with a like shaped top end of drive shaft 32, as shown in FIGS. 3 and 6.

Extending from the valve gate 30 at its bottom end 40, which proximal the dispensing container flat floor section 22, is an anti-drift pin 42 (FIGS. 4A and 4B), which extends into receptacle 46 in the substantially flat portion 22 of the base end 16 of container 10. This anti-drift pin arrangement prevents valve gate 30 from moving in a horizontal fashion and maintains proper valve alignment.

Opposite valve gate anti-drift pin 42 at the top end of valve drive shaft 32 is valve operator 34. In one embodiment of the invention, valve operator 34 takes the form of the top of container 10 (FIG. 4A). The combined valve operator/top 34 engages the container in a snap-fit manner, by including a circumferential recess 50, which engages a circumferential ridge 52 at the top end of container 10. In the preferred embodiment, this snap fit engagement is substantially liquid tight yet is not completely airtight to prevent drawing a vacuum within the interior chamber 14 of container 10 as its contents are dispensed through dispensing openings 24.

Also included at the top of container 10, preferably integral with the top of the container is a valve operator rotational position limiter 54. Position limiter 54 includes a partially circumferential recess 56 in valve operator 34 (FIG. 6). Within recess 56, valve position limiter protrusion 58 (FIG. 4A), which is preferably integrally molded into the top of the container 10, travels, where it butts against first and second ends 60 and 62 of recess 56. Thus, the valve operator 34 can have positive open and shut positions. This would eliminate the need for a user to align valve gate 30 into open and shut positions with respect to valve dispensing openings 24 using visual alignment techniques. Accordingly, the disclosed valve arrangement is suitable for both transparent and opaque containers.

Figure 7:
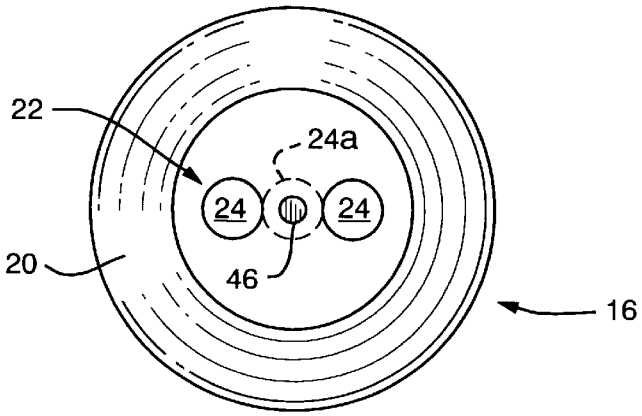
FIG. 7 is a top view of the base of the base end dispensing container of the present invention showing the sloped floor, the substantially flat floor area, and two dispensing openings.

Valve dispensing openings 24 may take any number of configurations. FIG. 7 shows one such configuration, which includes two valve dispensing openings orientated at opposite sides of the substantially flat floor section 22 of dispensing container base 16. Valve dispensing openings 24 are configured in an angled arrangement such that they meet at a lower end of the container floor 20A (FIG. 4A) to form a single dispensing opening 24A (FIG. 4A). Of course, any valve gate/valve dispensing opening arrangement may be utilized, including any number of valve dispensing openings and complex valve gate geometries.

Figure 8:
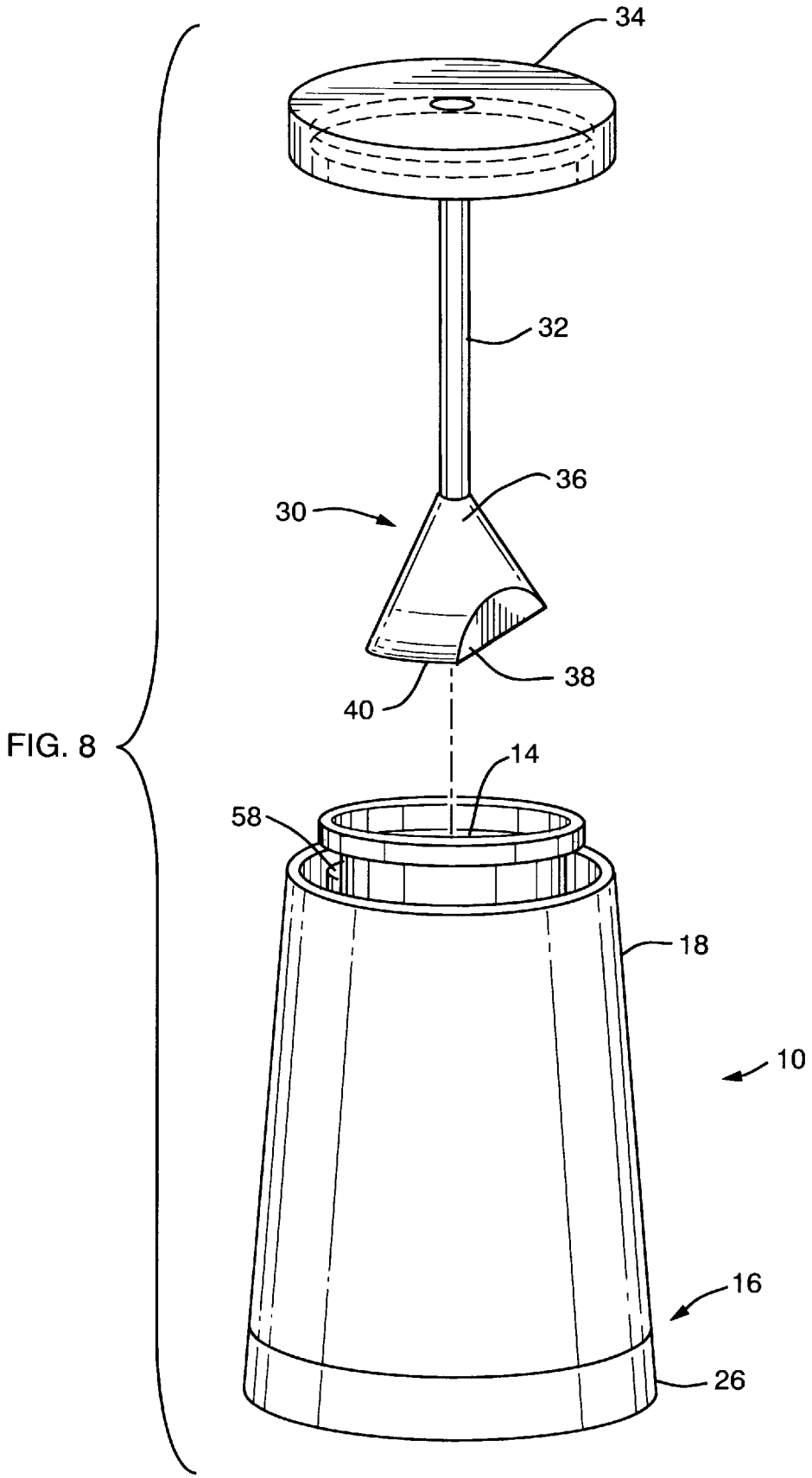
FIG. 8 is an exploded perspective view of one embodiment of the base end dispensing container of the present invention showing a container having a larger base end area to provide enhanced stability.

In addition to a variety of valve gate and dispensing opening geometries, container 10 itself may take a number of geometries. For example, FIG. 8 shows a dispensing container 10 manufactured according to the principles of the present invention, which has a base area 16, which is larger than top section 18. This type of arrangement would promote enhanced containers stability when it is rested upon legs 26. Of course, container 10 may be manufactured in any shape to correspond to common and well known shapes of certain consumable products. Container 10 may also be manufactured out of a variety of suitable, squeezable materials, such as transparent or opaque plastics. The container 10 may also be made of a combination of transparent, translucent or opaque plastics. For example, the walls of container 10 surrounding interior chamber 14 may be manufactured of substantially transparent high density polyethylene (HDPE) while base section 16 is manufactured out of a colored, opaque HDPE material. The multiple container materials may be joined using chemical or thermal bonding techniques, which are well known in the art of container manufacture.

Modifications and substitutions by one of ordinary skill in the art are considered to be within the scope of the present invention which is not to be limited except by the claims which follow.

What is claimed is:

1. A dispensing container, especially suitable for dispensing a viscous flowable liquid comprising:

an elongated, squeezable container having an inner chamber for holding said viscous flowable liquid, said container having a lower base end and an upper, top end, said base end including a sloping floor of said inner chamber, an attached support structure for supporting said container in an upright position, at least one dispensing opening passing through said floor, said container further including a rotationally operable valve gate for selectively opening and closing said at least one dispensing opening, a valve drive shaft communicating between said valve gate and a valve operator located at said top end of said container, wherein when said valve operator is positioned in an open position, the valve gate is rotated by said drive shaft to allow said liquid to flow through said at least one dispensing opening and out of said container inner chamber and when said valve operator is positioned in a closed position, the valve gate is rotated by said drive shaft to shut said at least one dispensing opening and prohibit the flow of said liquid out of said container inner cavity.

2. The container as claimed in claim 1, wherein said valve gate comprises a smaller area at a top end distal from said container floor and a larger area at a bottom end proximal said container floor to operate in conjunction with said sloping floor to permit substantially all of the liquid stored in said container to flow out of said at least one opening.

3. The container as claimed in claim 2, wherein said base area further comprises a substantially flat floor section, centrally located and adjacent to said sloping floor of said container and wherein said at least one dispensing opening passes through said substantially flat floor section.

4. The container as claimed in claim 2, wherein said valve gate comprises a conically shaped member having at least one section removed proximal said larger end.

5. The container as claimed in claim 2, wherein said valve gate comprises a hemispherically shaped member having at least one section removed therefrom.

6. The container as claimed in claim 1, wherein said valve operator comprises a container top and wherein said container further comprising a circumferentially ridged neck at said upper top end of said container and said container top comprises a corresponding circumferential recess to engage said circumferentially ridged neck to allow said operator to rotate along said ridge when said top of said container is snapped into place, said ridge and said recess sized to provide a substantially viscous liquid tight seal when said top is snapped in place.

7. The container as claimed in claim 6, wherein said circumferentially ridged neck and said circumferential recess in said container top are sized to create a substantially viscous liquid tight seal when said container top is snapped into place on said container.

8. The container as claimed in claim 7, wherein said circumferential ridge and said circumferential recess further comprise integral stops to provide positive indication of said open and shut positions.

9. The container as claimed in claim 1 further comprising an anti-drift pin extending from said bottom end of said valve gate, said anti-drift pin extending into a receptacle in said floor to maintain valve alignment.

10. The container as claimed in claim 1, wherein said at least one dispensing opening comprises dispensing openings oriented in a v-shaped arrangement to allow said viscous liquid to flow out of said container from opposite sides of said valve gate and out a common, substantially centrally located dispensing port in said container base.

11. The container as claimed in claim 1, wherein said container support structure is integral with said container base and extends from said base in a downward direction from said container floor a distance sufficient to elevate said at least one dispensing opening above a surface upon which said container is rested to avoid contamination of said viscous liquid within said container through said at least one dispensing opening.

* * * * *